US006683236B2

(12) United States Patent
Davis et al.

(10) Patent No.: US 6,683,236 B2
(45) Date of Patent: Jan. 27, 2004

(54) ONE PIECE COMPOSITE GUITAR BODY

(76) Inventors: Stephen J. Davis, Via Foresto Vecchio, 6, 31011 Asolo (IT); Richard Janes, 169 Ridgewood Way, Burlington Township, NJ (US) 08016; C. Malcolm Bash, 21 Washington Dr., Cranbury, NJ (US) 08512; Peter J. C. Chou, 78, Chomg Der 2nd Rd., 2nd Sec., Taichung (TW)

( * ) Notice: Subject to any disclaimer, the term of this patent is extended or adjusted under 35 U.S.C. 154(b) by 0 days.

(21) Appl. No.: 09/965,970

(22) Filed: Sep. 28, 2001

(65) Prior Publication Data

US 2003/0070528 A1 Apr. 17, 2003

(51) Int. Cl.[7] ..... G10D 3/00
(52) U.S. Cl. ..... 84/291; 84/290; 84/261
(58) Field of Search ..... 84/290, 291, 267, 84/274, 275

(56) References Cited

U.S. PATENT DOCUMENTS

| | | | | | |
|---|---|---|---|---|---|
| 5,333,527 | A | * | 8/1994 | Janes et al. | 156/245 |
| 6,011,205 | A | * | 1/2000 | Tucker et al. | 84/290 |
| 6,087,568 | A | * | 7/2000 | Seal | 84/193 |
| 6,262,353 | B1 | * | 7/2001 | Murray | 84/290 |

* cited by examiner

*Primary Examiner*—Kimberly Lockett
(74) *Attorney, Agent, or Firm*—Edward P. Dutkiewicz

(57) ABSTRACT

A body for a stringed instrument comprising a front face and a back face and a continuous side face there around; and an exterior laminate, the exterior laminate being formed of a plurality of composite layers including an interior layer, the composite layers of the laminate also including at least one supplemental layer, each layer including strands enveloped in an associated polymeric binder, with each subsequent layer being in intimate contact with the next adjacent layer.

16 Claims, 4 Drawing Sheets

ONE PIECE COMPOSITE GUITAR BODY

BACKGROUND OF THE INVENTION

1. Field of the Invention

The present invention relates to a one piece composite guitar body and, more particularly, pertains to tailoring the sound produced by a stringed instrument by virtue of its construction.

2. Description of the Prior Art

Guitar bodies may be classified into 2 general types: electric and acoustic. The electric guitar body is traditionally solid, comprised typically of solid wood or wood laminations. The acoustic guitar body, relying solely on the vibration of the sound board and box, is traditionally hollow by design. This invention describes an improved guitar body made from composite materials that can be made into either an electric guitar body, or an acoustic guitar body, or a variation in between.

Traditionally, a solid body stringed instrument is one wherein the body lacks a cavity and a soundboard and which carries one or more electrical pickups. These pickups transform the string vibrations into electrical signals which are subsequently amplified and usually modified and then transformed into sound waves to create sounds related to string vibrations. Commonly, these bodies have been made from solid pieces of wood which are carved to define specific shapes including various recesses and openings for receiving bridges, pickups, and other components attached to the bodies.

The type of wood used on solid bodies varies but is limited to densities between 0.3 g/cm3 and 0.6 g/cm3 so that the weight and tonal qualities of the guitar are retained. These preferred woods are expensive and in some cases, rare and exotic. Some examples are basswood, swamp ash, alder, mahogany, and maple.

Despite the fact that electrical pickups in the solid body transform the string vibrations into various sounds, the solid body also effects the tone of the guitar. For example, softer woods such as basswood produce a somewhat deader, softer tone while harder woods such as alder produce a slightly brighter note with more sustain. This is because of the sympathetic relationship between the strings and the body. For example, a harder, stiffer wood will transmit string vibrations faster resulting in a note with more attack and a brighter sound.

It should be noted that these variations in tone due to different woods are limited because wood itself is limited to its internal structure of aligned cellulose fibers. Because of this, wood can be termed nearly homogeneous. The sound differences generated by different wood types can sometimes only be detected by an expert. Often, the type of strings and pickups used produce more tonal difference than the type of wood used.

The problems related to wood bodies for electric guitars have been numerous. Wood bodies, for example, change dimension when exposed to changes in temperature, humidity, or other environmental factors. These dimensional changes, at a minimum, result in tonal variations due to tension changes in the string and scale length changes. Long term effects can be more drastic such as warping and cracking which can leave the guitar useless.

Still another problem with wood used for solid body electric guitars is the large variation in densities of woods currently used. The fluctuations of density throughout a wood genus leave the guitar manufacturer in the position of manufacturing guitars which span a large range of weights and tonal qualities.

Additionally, wood used for the body of an electric guitar cannot withstand bumps normally associated with guitar playing, resulting in dents caused by such impacts.

There have been several attempts to create an electric guitar body using alternative synthetic materials. These attempts, however, have failed as a successful replacement for wood.

In the case of U.S. Pat. No. 5,054,356 of Farnell, Jr., a guitar body is described made primarily of rigid closed cell foam which is partially covered and bonded to flat panels of plastic sheet material having a thickness of about 2.5 mm (0.1 inches). An edge wall of plastic material is subsequently wrapped around the plastic sheet and foam sandwich thereby leaving the foam exposed. The theory is that the cells of the foam alternately pressurize and depressurize to enhance the musical output of the guitar. Because the foam is exposed, a deader sound is generated.

In the case of Cove, U.S. Pat. No. 4,185,534, the use of a foamed polymeric material to fabricate the body necessitated the neck continuing through the entire body. This is because the foam alone, due to the lack of structural fiber resin reinforcement, is not strong enough to hold the strings at tension. Furthermore, the large presence of exposed foam deadens the tone of the guitar and makes it susceptible to impact damage.

In U.S. Pat. No. 4,290,336 by Peavey, the body is molded into two major portions, like a clamshell, necessitating a secondary operation of screwing the two halves together. This method requires the addition of a trim molding in order to conceal the seam where the two halves are joined together. In addition, this design has connectors between the top and bottom surfaces, which limits the vibrational response of the shell of the body, which will reduce the tonal qualities of the guitar body. This results in a body with numerous interfaces which creates relative movement and damps the sustain of the note. This design, therefore, needs only polymeric materials, not composite materials as described in the present invention.

In the case of U.S. Pat. No. 4,334,453 of Morrison, a plastic shell is molded around a reduced dimension wood core. The wood is left exposed in the region of the pickups in order to retain the desired sound of wood. This invention produces essentially a wood guitar body with a plastic cover. The purpose of this method is to reduce the cost of the guitar body without having the inferior tonal qualities of plastic. This design does not behave like a unitary shell as described in the present invention.

In the case of Fishman, et. al. in U.S. Pat. Nos. 5,189,235, 5,305,674, and 5,337,644, a guitar body is described which is first cut out of a light weight soft wood, then covered with carbon fiber and fiberglass prepreg and bonded together in a secondary operation using a common vacuum bag process for consolidation pressure. The composite outer laminate offers reinforcement for the weaker soft wood used. This combination is used to produce a light weight guitar body but requires thin shapes in order to achieve the desired light weight. Furthermore, this design does not behave like a unitary shell as described in the present invention.

In the case of Soika, et. al., U.S. Pat. No. 4,144,793, a one piece acoustic guitar body is created through the use of conventional spin or rotocasting techniques. The body created is hollow, polymeric, and without fiber reinforcement. Due to the lack of fiber reinforcement, the design is limited because of the superior strength of the fiber composite and the lacks the options of customizing the tone of the guitar by varying the fiber type and orientation.

There have also been attempts to produce a hollow acoustic guitar body, but none have achieved the desired performance of a unitary shell of the present invention.

In the case of Jones, U.S. Pat. No. 4,213,370, a hollow plastic body is described with a rigid vertical outside wall, connecting to a sound board using a joint design. Although the patent mentions fiber reinforcements, it is proposed to produce this part via injection molding, thus limiting the fibers to short lengths without orientation. This limits the design due to limited strength, as evidenced by the bracing required and the joint design to attach the sound board. In the present invention using a unitary shell of continuous fiber reinforcement, the need for bracing and complex joint design is eliminated.

In the case of John, U.S. Pat. No. 4,408,516, a graphite fiber violin is described where the sound box of the violin is made from carbon fiber prepreg material. The top and bottom sound boards and side wall section are produced separately, then assembled together using a flexibilized epoxy glue. The top and bottom sound boards are connected using a brass sound post. Although this design using oriented fiber reinforcement, it is not a unitary shell by design, since the top and bottom sound boards and side wall section are molded separately. Finally, the sound post which connects the top and bottom sound boards limits the vibrational response of the body to act as a unitary shell.

While these devices fulfill their respective, particular objectives and requirements, the aforementioned patents do not describe a one piece guitar body that allows tailoring the sound produced by a stringed instrument by virtue of its construction.

In this respect, the one piece composite stringed instrument according to the present invention substantially departs from the conventional concepts and designs of the prior art, and in doing so provides an apparatus primarily developed for the purpose of generating sounds which may be varied by varying the construction.

Therefore, it can be appreciated that there exists a continuing need for a one piece composite guitar body which can tailor the sound produced by virtue of its one piece composite construction. In this regard, the present invention substantially fulfills this need.

SUMMARY OF THE INVENTION

In view of the foregoing disadvantages inherent in the known types of guitars now present in the prior art, the present invention provides an improved one piece composite guitar body for providing tailored sounds. As such, the general purpose of the present invention, which will be described subsequently in greater detail, is to provide a one piece composite guitar body which has all the advantages of the prior art and none of the disadvantages.

To attain this, the present invention essentially comprises an electronic guitar body for tailoring the sound produced by virtue of a one piece composite construction. Such construction comprises, in combination a front face and a parallel back face having a common shape formed with a lower curved edge and an upper sinusoidal edge with a central neck pocket formed therein and with sinusoidal side edges there between. The body also has a continuous side face there around between the edges of the front face and the edges of the back face and with an essentially common distance between the majority of the extents of the front face and the back face. Also part of the combination is a plurality of discontinuities formed within the front face. Such discontinuities include a hole for bridge installation extending from the front face to the back face and also include a plurality of electronic cavities extending downwardly from the front face to a distance less than the distance between the front face and the back face. Also included within the combination is an interior one-piece core with an exterior surface fabricated of a rigid foam of a type adapted to abate shrinkage during the heat of molding, preferably polyurethane. Lastly as part of the combination is an exterior laminate in intimate contact with the entire exterior surface of the core, the exterior laminate being formed of a plurality of composite layers including an interior layer of linearly aligned strand or fibers. All of the strands are essentially inextensible fibers, preferably fiberglass. The strands of each layer are enveloped in an associated polymeric binder, preferably epoxy. The interior most ply includes linearly aligned fibers or strands in intimate contact with the core and with each subsequent layer being in intimate contact with the next adjacent layer.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is, accordingly, an object of this invention to create a composite guitar body with a continuous unitary shell and optional internal core where the body has:

- tonal qualities of attack, sustain, and harmonics which can be varied by design to achieve the type of sound desired.
- a predictable and repeatable sound from part to part.
- replicated the sound of popular wood bodies.
- a unique tonal response by utilizing fibers in specialized directions of orientation.
- resistance to changes in temperature and humidity.
- a high strength to weight ratio.
- different degrees of stiffness and density in various parts of the body to achieve unique tonal responses.
- eliminated the costly and laborious finishing method through the use of an exterior gelcoat.
- the behavior of a single component body.

It is another an object of the present invention to provide a one piece composite guitar body which has all of the advantages of the prior art guitars and none of the disadvantages.

Even still another object of the present invention is to provide a one piece composite guitar body for tailoring the sound produced by virtue of a one piece composite construction.

Lastly, it is an object of the present invention to provide a body for a stringed instrument comprising a front face and a back face and a continuous side face there around; and an exterior laminate, the exterior laminate being formed of a plurality of composite layers including an interior layer, the composite layers of the laminate also including at least one supplemental layer, all of the strands being essentially inextensible fibers, the strands of each layer being enveloped in an associated polymeric binder, with each subsequent layer being in intimate contact with the next adjacent layer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

For a full understanding of the nature and objects of the invention, reference should be made to the following detailed description taken in conjunction with the accompanying drawings in which.

The same reference numerals refer to the same parts throughout the various Figures.

DESCRIPTION OF THE PREFERRED EMBODIMENT

Figure 1:
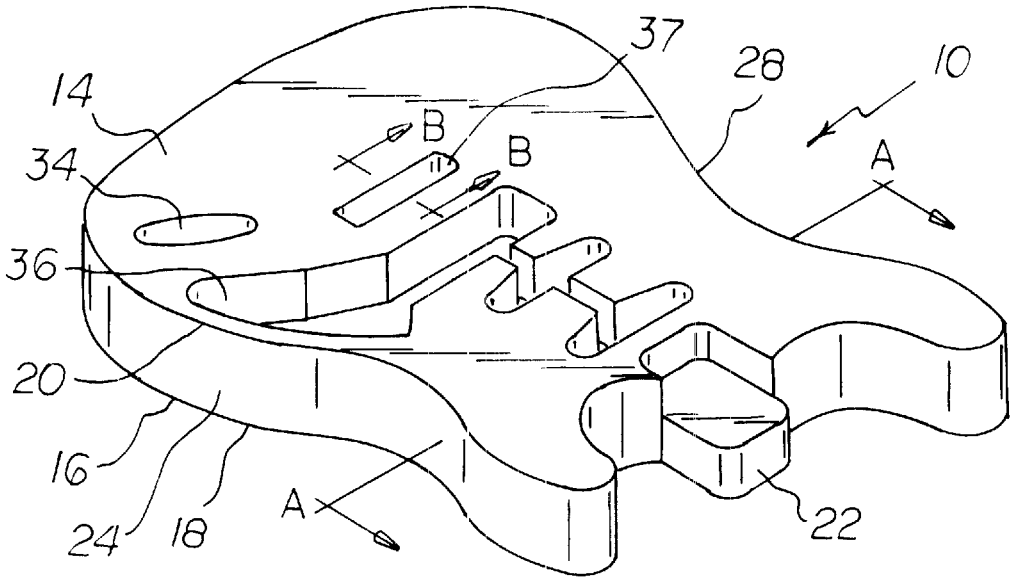
FIG. 1 is a front perspective view of a one piece solid guitar body guitar showing the geometry and features of the preferred embodiment of the present invention.

With reference now to the drawings, and in particular to FIGS. 1, 2, 3A and 3B thereof, the preferred embodiment of the one piece composite guitar body embodying the principles and concepts of the present invention and generally designated by the reference numeral 10 will be described. The present invention, the one piece composite guitar body 10 is comprised of a plurality of components individually configured and correlated with respect to each other so as to attain the desired objective.

The construction of the present one piece composite guitar body, according to the preferred embodiment, comprises, in combination a front face 14 and a parallel back face 16. Such faces have a common shape formed with a lower curved edge 18 and an upper sinusoidal edge 20 with a central neck pocket 22 formed therein and with sinusoidal side edges 24 there between.

The body 10 also has a continuous side face 28 there around between the edges of the front face and the edges of the back face. The side edges provide for an essentially common distance between all or at least a the majority of the extents of the front face and the back face.

Also part of the combination is a plurality of discontinuities 34, 36 formed within the front face. Such discontinuities include a hole 37 for bridge installation extending from the front face to the back face and also include a plurality of electronic cavities 34, 36 extending downwardly from the front face to a distance less than the common distance between the front face and the back face.

Also included within the combination is an interior one-piece core 40 with an exterior surface fabricated of a rigid foam preferably polyurethane.

Lastly as part of the combination is an exterior laminate 46. Such laminate has its entire interior surface in intimate contact with the entire exterior surface of the core. The exterior laminate is formed of a plurality of composite layers including an interior layer 48 of linearly aligned longitudinal strands 50. The composite layers of the laminate also include at least one supplemental layer 54 of continuous aligned longitudinal strands 56. All of the strands are essentially inextensible fibers, preferably fiberglass.

The strands of each layer are enveloped in an associated polymeric binder 60, preferably epoxy. The interior most layer 50 is linearly aligned strands or fibers in intimate contact with the core and with each subsequent layer being in intimate contact with the next adjacent layer.

Figure 3A:
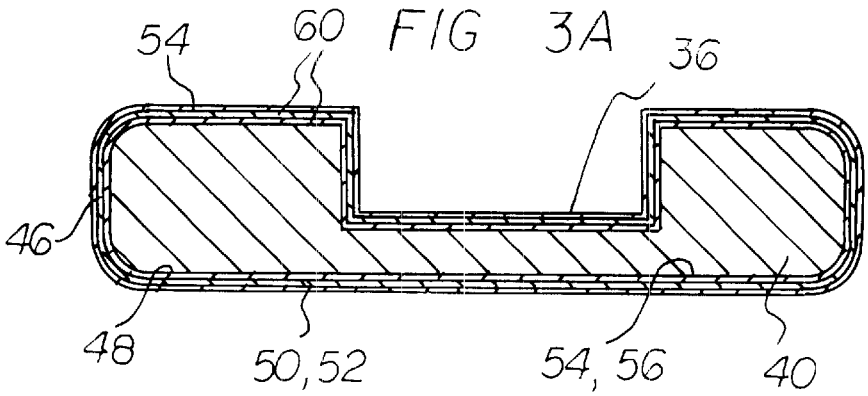
FIG. 3A is a cross section view taken along the line A—A in FIG. 1 illustrating an electronic cavity.
Figure 3B:
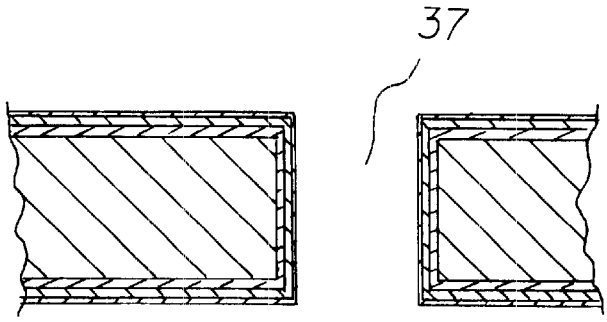
FIG. 3B is a cross section view taken along the line B—B in FIG. 1 showing the hole.
Figure 4:
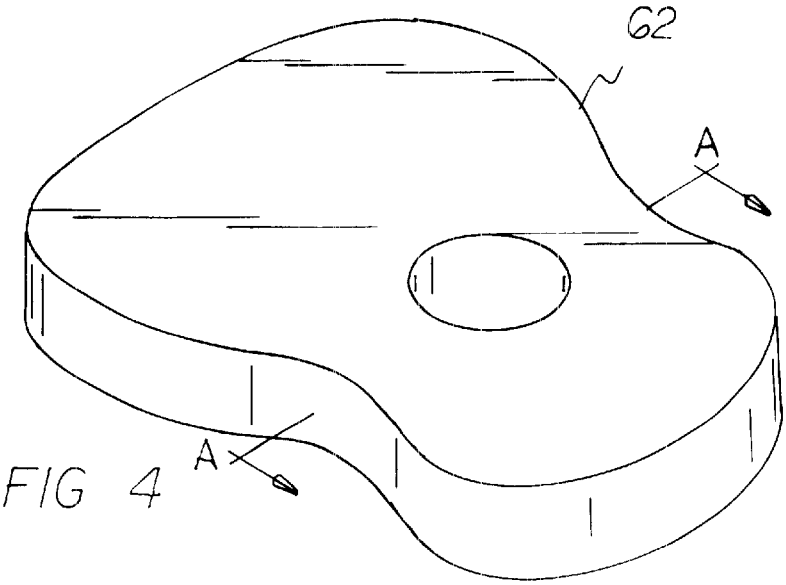
FIG. 4 is a front perspective view of a one piece guitar body guitar showing an alternate embodiment of the invention.
Figure 5:
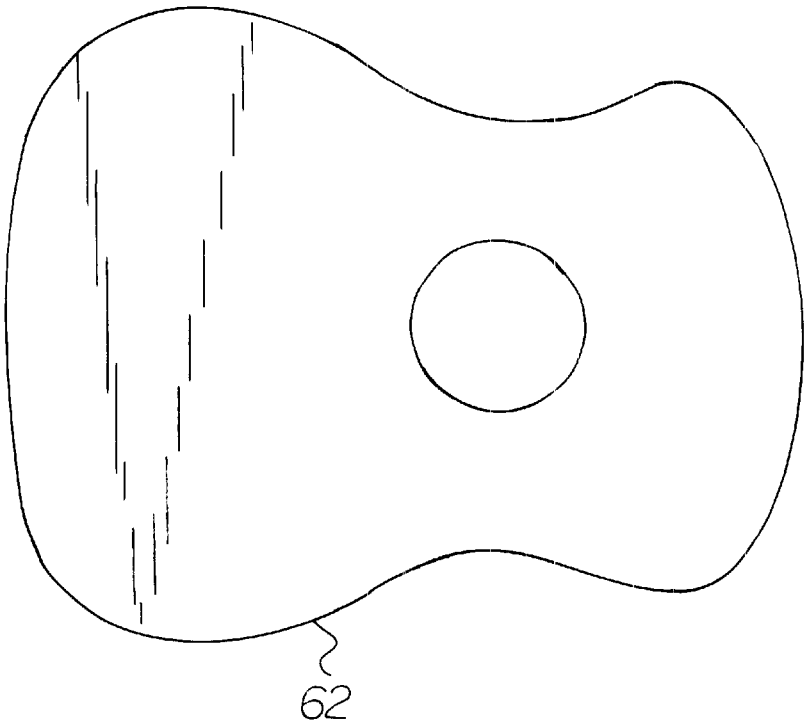
FIG. 5 is a front elevational view of the one piece body of the alternate embodiment shown in FIG. 4.
Figure 6A:
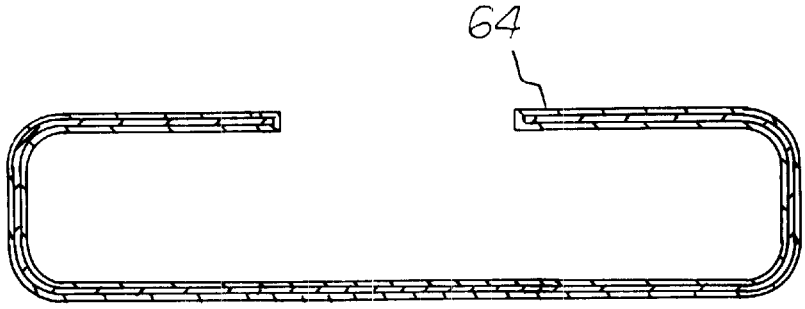
FIG. 6A is a cross section view taken along the line A—A in FIG. 4 illustrating the sound hole in the front face.

An alternate embodiment of the invention is illustrated in FIGS. 4, 5, and 6A. Such alternate embodiment is a one piece hollow guitar body 62 essentially the same as that described above in the primary embodiment of FIGS. 1, 2, 3A and 3B. Such body, however, is hollow and excludes the core of the prior embodiment. This body is in the shape of a traditional acoustic design, where sound is generated primarily by the vibrating front face. Consequently, this design differs in how sound is generated versus the electric guitar body, but is still unitary in design. In addition, as an option, the exterior of the laminate is coated with a gelcoat layer 64. Such gelcoat layer could be applied to the laminate of the primary embodiment.

Figure 2:
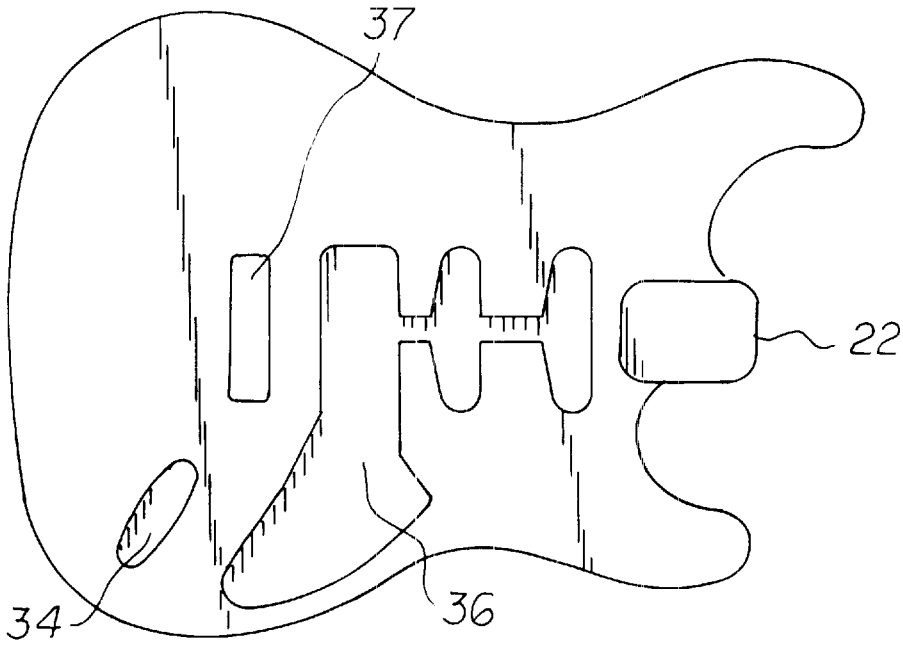
FIG. 2 is a front elevational view of the solid body of the guitar body shown in FIG. 1.

The guitar body according to the invention is shaped similar to traditional guitar bodies as shown in FIGS. 1 and 2 for an electric guitar and the FIGS. 4 and 5 for an acoustic guitar. The body is curved in shape and finished with a smooth outer surface. Various cavities are formed to accommodate other components such as the neck cavity, which is sized and shaped to fit the butt end of the neck, and other cavities which are sized to accommodate electronic pickups, circuitry, and other components. A bridge device which anchors the strings is usually mounted on the back side of the guitar. This may or may not require a hole in the front face of the guitar body. The outer surface is the shell of the guitar body and is continuous in structure as it passes from the front side to the side wall to the back side. In addition, it is continuous as it passes from the outer surface into the walls and floors of the cavities as well as hole. In other words, all exposed surfaces have the shell in continuous coverage. However, due to the fact that an internal core does not exist, it may be necessary to add more reinforcement layers in the corners or on the front and back faces to meet strength requirements. These reinforcements may increase the thickness of the laminate in local areas, but still maintain the unitary structure.

FIG. 2 shows a front elevational view of the front side of the guitar body showing the cavity 37 which accommodates a spring assembly which is activated by the arm of the tremolo to change the frequency of the note. The outer surface is continuous from the back side into the walls and floor of cavity and into the walls of hole.

FIGS. 3A and 3B show the detail via cross section taken along the lines A—A and B—B of the guitar body. The outer surface, if desired, is comprised of a gelcoat which forms the outermost portion of the guitar body and is used as a cosmetic layer. Note more particularly the alternate embodiment of FIG. 6A. The gelcoat layer is made of a polyester resin model Ram82-X58 from Lilly Industries and is applied to the mold surface and transfers to the part during the molding cycle. The gelcoat layer can be applied in a thickness of 0.5–1.0 mm and buffed to a lesser thickness following the molding cycle.

The layer below the gelcoat is the laminate or structural shell of the guitar body comprised of at least one, preferably 2 layers of fiberglass reinforced epoxy resin.

The foam core is comprised of a polyurethane foam which is poured into the mold cavity after the gelcoat and structural shells have been laid up on the mold cavity. The mold is closed and the chemical reaction of the foam resin and catalyst create an expanding foam and exothermic reaction. The pressure of the expanding foam compresses the fiberglass layers to the gelcoat to insure a unitary structure. The exothermic reaction helps to cure the epoxy resin of the structural layers.

FIGS. 3A and 3B also shows the continuous outer surface as it passes from the front side into the walls and floor of cavity and to the side wall to the back side.

After the molding process, additional gelcoat may be sprayed onto the outer skin of the guitar body, in order to correct any imperfections which may be visible, such as those in the vicinity of the mold parting line. This gelcoat may be buffed to a high luster along with the preexisting gelcoat to produce an overall beautiful uniform finish. The gelcoat may also be painted.

An alternate embodiment of the invention, as shown in FIGS. 4, 5, and 6A, is a hollow acoustic guitar body. Such alternate embodiment is shaped similar to traditional hollow acoustic wood guitar bodies as shown in FIGS. 4 and 5. The body is unitary like the solid body, but more boxy in shape to produce the desirable acoustic response. Holes in the unitary shell are optional such as on the top surface to allow passage of air due to the vibrations of the shell structure. The optional layer of gelcoat is shown in the alternate embodiment. It should be appreciated that the gelcoat could also be utilized in the primary embodiment.

An alternative embodiment of the invention is shown in FIGS. 4 and 5 showing the invention in a traditional acoustic body shape. The traditional acoustic is more planar in shape than the electric body, with flat top and bottom faces, with a vertical side wall connecting the two faces. In addition, the corners tend to be more sharp, and the neck attaches to the body in a different way, by attaching to the vertical side wall. In addition, the traditional acoustic guitar uses braces on the underneath side of the top sound board, which are needed for strength purposes. This bracing limits the vibrational response of the sound board. The proposed invention would eliminate such bracing, but as mentioned previously, may require additional reinforcements which will increase the thickness of the laminate in certain areas.

Figure 7:
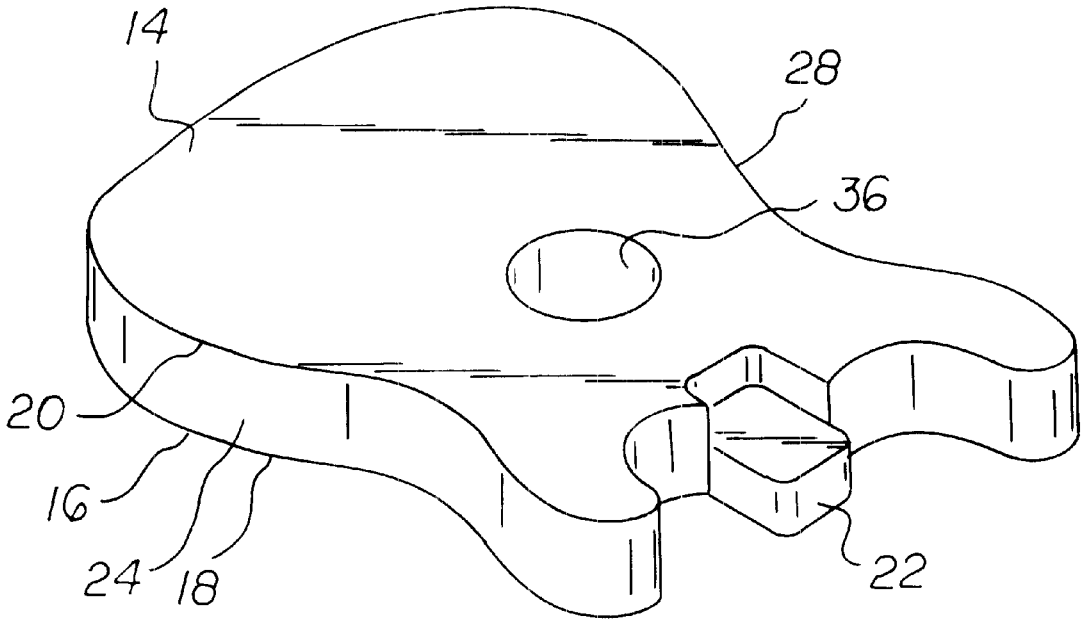
FIG. 7 is a front perspective view of another embodiment of the invention.

A variation in between the traditional acoustic shape and traditional shape is possible to give the performance of an acoustical guitar with the look of an electric guitar. Note FIG. 7.

Another variation is to use the shape of an electric guitar, with the option of electronic pick ups inside the hollow cavity connected to an amplifier to produce a unique sound.

As may be understood from the forgoing, the present invention as described herein is a novel guitar body which is comprised of a continuous unitary shell surrounding an optional internal foam core. Both components, shell and core, have unique roles in generating musical characteristics such as:

Attack: the speed at which the note is created.

Sustain: the duration of a note.

Overtones: a number of higher order frequencies present in a particular musical sound.

Tone: the fundamental frequency or pitch to generate a musical sound. Sounds may be a combination of tones, partial tones, and overtones.

Harmonics: when higher order frequencies occur which are integral multiples of the fundamental frequency or note.

The shell of the body can be thought of as a bell. The walls of a bell vibrate and produce a sound. The exterior shell of the guitar body, being in close proximity to the strings, is excited by the vibrations of the strings and will in turn vibrate at numerous frequencies depending on its properties such as size, thickness, density, stiffness, and damping characteristics. The responsiveness of the shell to string vibrations increases as it becomes thinner and lighter, especially without any internal ribs, support structure, or core which will reduce or damp the vibrations of the walls of the shell.

A unitary continuous shell is desired to transmit the vibration around the entire shell. This has been found to provide superior tonal quality by enhancing attack and lengthening sustain.

A unitary continuous shell has also shown to limit the amount of overtones present in a sound. This is desirable because if a guitar body vibrates at too many frequencies, the numerous overtones tend to interfere with each other and limit the richness of the sound. This is the advantage of wood and is why composite solid guitar bodies have yet to be successful. The continuous unitary shell creates overtone containment which adds to the fullness of the sound.

A core is sometimes desired to control sound quality of the solid guitar body, especially for electric guitars. Although the density and stiffness of the core can affect sound characteristics in a similar manner as in the shell, the role of the core is different than the shell and is twofold: to act as a damper to control the vibration of the shell, and to keep the shell in a tensioned state. Controlling shell vibration aids in customizing the type of sound desired. The advantage of a shell/core relationship is that properties of each can be mixed and matched to produce characteristics not possible with wood or other previous designs. For example, if it is desired to enhance attack but suppress sustain, the optimum combination would be a light, stiff shell with a soft, heavy core.

The second role of the core is to keep the exterior shell under tension. Having two dissimilar components increases the chance that excess noise can possibly be generated due to relative movement between the two components. This relative movement can also cause damping which will affect sound quality. Having the core provide an internal pressure against the exterior shell will assure that firm contact between the two components exists throughout the body. This forms a more unitary structure and limits overtone generation and improves the richness of the sound. However, the core should not be too stiff to act as a brace between the top and bottom surfaces of the guitar body, which would limit the vibrational response of the unitary body.

Another role of the core which is unrelated to sound is to provide a means to retain the mounting screws used to attach the strap and in some models, the tremolo springs. The core must be strong enough so that the pulling force on the screws doesn't exceed the tear strength of the core. If the density of the core needs to be so high as to affect the sound adversely, then it is desirable to locally increase the core density or change the core material in these areas. For example, a small piece of wood can be placed in these areas without affecting the performance of the guitar body.

The materials used in the shell and core must have different properties due to their different roles. The modulus, hardness, and specific gravity properties of the shell are preferably much greater than those respective properties of the core. The table below lists the available range of properties for each component.

TABLE 1

Property Ranges for Solid Guitar Body Components

| Property | Shell | Core |
|---|---|---|
| Modulus | 0.5–30 msi | 1–10 ksi |
| Specific Gravity | 1.6–3.0 | 0.1–0.8 |

By changing the combination of the above properties, it is possible to generate a wide variety of sounds. For example, to enhance the brightness or the treble portion of the tone, it would be advised to use a stiff, hard, and light shell and core. To enhance the bass portion of the tone, it would be advised to use a flexible, soft, and heavy shell and core. It should be kept in perspective that the properties of the shell are much greater than those respective properties of the core. Table 2 below lists properties of each component which have been found to produce a desirable sound.

TABLE 2

Preferred Properties of Components for Overall Performance

| Property | Shell | Core |
|---|---|---|
| Modulus | 3–4 msi | 5–7 ksi |
| Specific Gravity | 2.7 | 0.5 |

It has been found that fiber reinforced resin provides an excellent choice for the shell. Fibers such as carbon fiber, fiberglass, and aramid fibers have been tried with success. Hybrid combinations of these fibers provide an alternative design of generating unique harmonic combinations. In addition, the anisotropic nature of fiber reinforced composites offers limitless combinations to custom tune harmonic response.

The resins available to house the fibers are numerous as well. Both thermoset and thermoplastic resins are suitable, with each providing various degrees of hardness, stiffness, and damping. Examples of thermoset resins are epoxies, polyesters, and vinylesters. Examples of thermoplastic resins are polyamides and acrylics. The preferred resins are epoxies and polyesters, due to their ease of handling and manufacturing, with the preference depending on the type of gelcoat used as described below.

The materials for the core are primarily foams, both closed and open cell structures, and both thermoset and thermoplastic based. Altering the density of the foam is easy, especially with a thermoset foam, by changing the ratio of catalyst to resin, which will affect the quality of sound. The best results have been achieved with a thermoset polyurethane open cell foam.

Several processes exist to manufacture the composite guitar body which are reliable and consistent. All methods utilize a fixed cavity mold to define the shape of the body. All methods must assure that the core and the shell remain pressurized against each other for the body to behave as a unitary structure. The exterior quality of the finished part must be of a very high luster to compete with the finish of wood bodies currently on the market. Molding articles out of composite materials often requires substantial post molding sanding and puttying efforts in order to prepare the surface for painting.

The preferred method of manufacture accomplishes all of the requirements above. The first step is to use a mold with a polished cavity to accommodate a gelcoat material which will be sprayed or brushed on to the cavity surface. The quality of the mold cavity is critical because gelcoats are well known for their ability to replicate the finish of the mold cavity. Gelcoats can be either polyester or polyurethane based, and are applied to the cavity in a thickness between 0.2 mm to 1.0 mm and allowed to partially cure to a tacky stage. Then the fiber reinforcement is applied which is impregnated with resin. The type of resin used needs to be compatible with the gel coat resin, e.g., a polyester resin when using a polyester gel coat, and an epoxy resin when using a polyurethane gel coat. The fiber/resin layer needs to completely cover the entire cavity of the mold so that when the part is molded, a continuous unitary shell is created. This includes continuing the reinforcement around the protrusions in the mold cavity which will form the cavities in the molded part. The fibers can be placed in different amounts and orientations, and combined with other types of fibers in order to add stiffness and strength to various locations of the solid body. Following the placement of the fiber reinforcements, the mold is closed and a measured amount of two part polyurethane foam is injected into the cavity of the mold. After the foam is introduced into the mold cavity, the injection aperture is sealed off, and the foam is allowed to react and cure, creating heat and internal pressure against the resin impregnated structural fiber and gelcoat shell. The generation of uniform internal pressure and temperature due to the exothermic reaction of the polyurethane creates a unitary part consisting of an internal foam core with a structural fiber and resin outer shell of predetermined thickness and strength. Finishing this part can be accomplished by merely buffing the gelcoat surface to achieve the luster desired. If another color is desired, then a painting operation is needed.

The above mentioned method can also be done without using a gelcoat. Finishing would then be done by conventional sanding, puttying, and painting methods. The gelcoat may also be painted if desired.

Another method to produce the solid guitar body is to first mold an undersize polyurethane foam core. Wrap fibers impregnated with resin around the foam core, being careful to create the continuous fiber reinforced shell. Place this preform into a matched cavity mold and apply pressure and heat to cure the resin. Remove the part from the mold and finish via painting.

Another method similar to the above uses a vacuum bag or autoclave instead of the matched metal mold. After the prepreg is wrapped around the foam core, the preform is placed inside a polymer bag and the bag is sealed. A vacuum is pulled inside the bag which collapses the bag and compresses the fiber/resin laminates on to the core. This assembly may be placed into an oven to cure the resin or the resin may cure at room temperature. Additionally, if greater laminate consolidation pressure is desired, the vacuum bagged preform may be placed into an autoclave oven which applies external pressure and heat. In either case, a solid body is produced with a continuous unitary shell and is ready for finishing.

Another viable method is called Resin Transfer Molding (RTM) whereby the core is wrapped with dry fiber reinforcement. This preform is placed into a matched cavity mold with a seal around the periphery of the cavity. A low viscosity resin is pumped into the cavity from one end of the body and a vacuum is drawn from the other end. The resin impregnates the fiber reinforcement, cures either by cross linking via thermoset reaction or by heat(or both) and provides a continuous unitary shell with a resin rich surface ready for painting.

A method to produce the hollow composite guitar body is to wrap the fibers impregnated with resin completely around a thin walled bladder such as made with polyamide or latex rubber, and place the assembly into a fixed cavity mold. Apply heat and internal pressure and inflate the bladder which will expand and consolidate and cure the fiber/resin laminate against the cavity of the mold producing a continuous unitary shell. The bladder may or may not be removed. This process will produce a hollow guitar body such as the type used for acoustic guitars. If a solid body is desired such as used with electric guitars, the appropriate shape needs to be molded, then foam can be injected into the cavity of the hollow shell. The part may be removed from the mold and finished using the conventional methods listed above.

Another method of producing the hollow or solid composite guitar body is to initially produce two halves of the body, for example, the top half and the bottom half. These halves can be made by compression molding fiber reinforced resin in a matched cavity mold by either using expandable rubber, a polymeric or rubber bladder, or by other external pressure means such as an autoclave. The two halves are removed from their respective molds, and assembled together and adhesively bonded to form the unitary shell. The design of the bond area can be an overlap joint with adhesive in between, or a butt joint where the edges of each half contact each other and a skirt of fiber reinforced material is placed over the seam to connect the two halves to form the hollow unitary shell. If the body desired is hollow for an acoustic guitar, a sound hole may be drilled in the top surface to give the guitar a traditional look. If a solid body is desired, foam can be poured into the hollow area and allowed to expand and bond to each half forming the unitary solid body.

Another method to produce the hollow body is to first mold the bottom face and side walls as a single unit, and then attach the front face using a joint design in the corners in order to form the hollow unitary shell.

With all of the above methods, the thickness, stiffness, and strength of the shell can be varied to meet design criteria. It has been found that the wall thickness of the shell is best around 0.5 mm, but wall thicknesses as thin as 0.1 mm or as thick as 4.0 mm are possible and in some cases, desirable. In addition, the wall thickness can vary throughout the shell including the top surface, bottom surface, and sides to achieve desired tonal qualities. Much of this depends on the sound desired, the size of the body, and the overall weight target of the body.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A body for a stringed instrument comprising:

a front face with at least one region for receiving a separate neck and the body also comprising an imperforate back face and a continuous side face there around; and an exterior laminate, the exterior laminate being formed of a plurality of composite layers including an interior layer, the composite layers of the laminate also including at least one supplemental layer, each layer being fabricated of strands of an essentially inextensible material enveloped in an associated polymeric binder, with each subsequent layer being in intimated contact with the next adjacent layer.

2. The body for a stringed instrument as set forth in claim 1 and further including a one piece core fabricated of a rigid material in contact with the interior of the laminate.

3. The body for a stringed instrument as set forth in claim 1 and further including a one piece core fabricated of a thermoset polyurethane open cell foam in contact with the interior of the laminate.

4. The body for a stringed instrument as set forth in claim 1 and further including a plurality of electronic cavities formed in the front face.

5. The body formed of an exterior laminate for a stringed instrument as set forth in claim 1 and further including a hole formed from the front face to the back face.

6. The body for a stringed instrument as set forth in claim 1 wherein the binder is fabricated of a hard resin material selected from the class of hard resin materials including epoxies, polyesters, vinylesters, polyamides and acrylics.

7. The body for a stringed instrument as set forth in claim 1 wherein the strands are fabricated of an essentially inextensible material selected from the class of essentially inextensible materials including carbon, aramid and fiberglass.

8. The body for a stringed instrument as set forth in claim 1 and further including a coating of gelcoat over the exterior laminate, the coating being based with a polymer selected from the class of polymers including polyester and polyurethane.

9. The body for a stringed instrument as set forth in claim 1 wherein the body is hollow.

10. An electronic guitar body for tailoring the sound produced by virtue of a one piece composite construction comprising, in combination:

a front face and a back face having a common shape formed with a lower curved edge and an upper sinusoidal edge with a central neck pocket formed therein for receiving a separate neck and with sinusoidal side edges there between, the body also having a continuous side face there around between the edges of the front face and the edges of the back face and with an essentially common distance between the majority of the extents of the front face and the back face;

a plurality of discontinuities formed within the front face including a hole for bridge installation extending from the front face to the back face and also including a plurality of electronic cavities extending downwardly from the front face to a distance less than the common distance between the front face and the back face;

an interior one-piece core with an exterior surface fabricated of a rigid foam of a type adapted to abate shrinkage during the heat of molding, preferably polyurethane; and an exterior laminate in intimate contact with the entire exterior surface of the core, the exterior laminate being formed of a plurality of composite layers including an interior layer of linear aligned strands or fibers cloth having continuous longitudinal strands and continuous latitudinal strands, the composite layers of the laminate also including at least one non-cloth layer of continuous aligned strands, all of the strands being essentially inextensible fibers, preferably fiberglass, the strands of each layer being enveloped in an associated polymeric binder, preferably epoxy, with the interior most ply being a linear aligned strands or fibers cloth in intimate contact with the core and with each subsequent layer being in intimate contact with the next adjacent layer.

11. The body for a stringed instrument as set forth in claim 1 wherein the instrument is an electric guitar.

12. The body for a stringed instrument as set forth in claim 11 and further including an internal core.

13. The body for a stringed instrument as set forth in claim 1 wherein the instrument is an acoustic guitar.

14. The body for a stringed instrument as set forth in claim 13 and further including an internal core.

15. An acoustic guitar body for tailoring the sound produced by virtue of a one piece composite construction comprising, in combination:

a front face and a back face having a common shape formed with a lower curved edge and an upper sinusoidal edge with or without a central neck pocket formed therein and with sinusoidal side edges there between, the body also having a continuous side face there around between the edges of the front face and the edges of the back face and with an essentially common distance between the majority of the extents of the front face and the back face;

with or without one or more sound holes positioned on the front face to a distance less than the common distance between the front face and the back face;

an exterior laminate formed of a plurality of composite layers including an interior layer of linear aligned strands or fibers cloth having continuous longitudinal strands and continuous latitudinal strands, the composite layers of the laminate also including at least one non-cloth layer of continuous aligned strands, all of the strands being essentially inextensible fibers, preferably fiberglass, the strands of teach layer being enveloped in an associated polymeric binder, preferably epoxy, with the interior most ply being linear aligned strands or fibers of cloth and with each subsequent layer being in intimate contact with the next adjacent layer.

16. The body for a stringed instrument as set forth in claim 1 wherein the region for receiving a separate neck is a neck pocket formed in the front face and side face.

* * * * *